US005975199A

United States Patent [19]

Park et al.

[11] Patent Number: 5,975,199

[45] Date of Patent: Nov. 2, 1999

[54] COOLING FIN FOR HEAT EXCHANGER

[75] Inventors: Hyun-Yeon Park; Young-Saeng Kim, both of Kyungki-do, Rep. of Korea

[73] Assignee: Samsung Electronics Co., Ltd., Suwon, Rep. of Korea

[21] Appl. No.: 08/991,410

[22] Filed: Dec. 16, 1997

[30] Foreign Application Priority Data

Dec. 30, 1996 [KR] Rep. of Korea ..... P96-77586

[51] Int. Cl.[6] ..... F28D 1/04; F28F 1/32

[52] U.S. Cl. ..... 165/151; 165/181; 165/DIG. 503

[58] Field of Search ..... 165/151, 181

[56] References Cited

U.S. PATENT DOCUMENTS

| | | | |
|---|---|---|---|
| 3,916,989 | 11/1975 | Harada et al. | 165/151 |
| 4,550,776 | 11/1985 | Lu | 165/151 |
| 5,685,367 | 11/1997 | Jun | 165/151 |
| 5,706,885 | 1/1998 | Kim | 165/151 |
| 5,727,625 | 3/1998 | Youn et al. | 165/151 |
| 5,752,567 | 5/1998 | Obosu | 165/151 |

FOREIGN PATENT DOCUMENTS

| | | | |
|---|---|---|---|
| 3406682 | 9/1985 | Germany | 165/151 |
| 92796 | 6/1983 | Japan | 165/151 |
| 15494 | 1/1992 | Japan | 165/151 |

*Primary Examiner*—Leonard Leo

*Attorney, Agent, or Firm*—Burns, Doane, Swecker & Mathis, L.L.P.

[57] ABSTRACT

A flat heat exchanger fin includes a body having arrays of louver groups formed therein. Each array includes four louver groups. The first and second louver groups are disposed over a respective pipe, with the second louver group disposed behind the first louver group. The third and fourth louver groups are disposed beneath a respective pipe, with the fourth louver group disposed behind the third louver group. Each louver group includes a plurality of louvers which form slits through the body. The slits extend transversely relative to the air flow direction and generally radially with respect to the respective pipe. Each louver group includes a proximate edge facing a respective pipe, and a remote edge facing away from the pipe. The remote edge is spaced from the respective pipe by a substantially constant separation distance. Dew-draining ridges are formed in the fin above, below, in front of, and behind respective pipes.

4 Claims, 8 Drawing Sheets

COOLING FIN FOR HEAT EXCHANGER

BACKGROUND OF THE INVENTION

Field of the Invention

The invention relates to a heat exchanger for an air conditioner, and more particularly to a cooling fin for a heat exchanger which provides an improved heat transfer performance.

A conventional heat exchanger for an air conditioner includes, as shown in FIG. 1, a plurality of flat vertical fins 1 arranged in a parallel relation to each other at predetermined intervals and a plurality of heat exchanging tubes 2 passing horizontally through the fins 1 perpendicular thereto. The air currents flow in the spaces defined between the fins 1 in the direction of the arrow in FIG. 1 and exchange heat with the fluid flowing in the heat exchanging tubes 2.

For a thermal fluid flowing around each flat fin 1, there has been known that the thickness of the thermal boundary layer 3 on both heat transfer surfaces of the fin 1 is gradually thickened in proportion to square root of the distance from the air current inlet end of the fin 1 as shown in FIG. 2. In this regard, the heat transfer rate of the fin 1 is remarkably reduced in proportion to the distance from the air current inlet end. Therefore, the above heat exchanger has a lower heat transfer efficiency.

For the thermal fluid flowing about each heat transfer pipe 102, it has been also known that, when lower velocity air currents flow in the direction of the arrow of FIG. 3, the air currents separate from the outer surface of the pipe 2 at portions spaced apart from the center point of outer surface of the pipe 4 at angles of 70-degree to 80-degree. Therefore, an air dead region 4 is formed behind each tube 2 in a direction of the air flow as shown in the hatched region of FIG. 3. In the air dead region 4, the heat transfer rate of the tube 2 is remarkably reduced so that the heat transfer efficiency of the above heat exchanger becomes worse.

In order to overcome the above problems, there has been proposed another solution as disclosed in Korean Patent Application No. 96-27642 filed on Jul. 9, 1996 by the present applicant. This heat exchanger, as shown in FIGS. 4 and 5, includes a plurality of heat exchanging tubes 2 which are fitted into the regularly spaced flat fins 1 such that the tubes 2 are perpendicular to the fins 1. The heat exchanger also includes a plurality of angled louver patterns which are formed adjacent the tubes 2 passing through each fin 1. Each louver pattern comprises a pair of louver groups located either above or below one of the tubes 2. A lower louver pattern disposed below a tube 2 comprises a first louver group 20 configured to guide an air current flow in a first direction, and a second louver group 40 which is inclined opposite to the first louver group such that the guided air current is guided in a different direction. An upper louver pattern located above a tube 2 comprises a third louver group 30 and a fourth louver group 50 inclined relative to one another. Each of the louver groups is radially oriented relative to a respective tube 2.

The first and third louver groups 20 and 30 are oriented in mirror image relationship to each other such that the air currents flowing over both surfaces of the flat fin 1 and in the area between adjacent tubes 2 become turbulent and mixed. Further, the second and fourth louver groups 40 and 50 are similarly placed in mirror image relationship to each other such that the air currents which have passed the groups 20 and 30 continue to traverse the remainder of the area between the tubes 2 and become turbulently mixed by the groups 40 and 50, thereby reducing the dead air region.

Each of the louver groups includes louvers 70–75 which are inclined obliquely relative to the plane of the fin, as can be seen in FIG. 5. That is, each of the louvers 71–74 has a left end L projecting past a first surface S1 of the flat fin 1, and a right end R thereof extending past a second surface S2 of the flat fin 1. Each louver provides a slit arranged transversely relative to the air flow. The louvers are formed by way of a cutting and twisting process so as to be integral with the flat fin 1. The fin 1 includes flat, solid portions 60, some of which are round and surround respective tubes 2. For example, one of those round areas occupies a region between upper ends of the louver groups 20, 40 and a lower outer circumference of an adjacent tube 2. The louver groups are radially oriented with respect to respective tubes 2.

The first and second louver groups 20, 40 are arranged symmetrical relative to each other and are separated by a solid portion 60 of the fin. The same is true of the third and fourth groups 30 and 50.

The louvers 70–75 of each group are sequentially arranged relative to one another without any solid fin portion disposed therebetween.

In the drawing, reference numeral 80 denotes beads or ridges which are vertically oriented. Each bead 80 defines a vertical longitudinal axis that perpendicularly intersects the axes of vertically adjacent pipes 2. The beads serve as water guides to drain water, or dew, that condenses on the tubes 2 or fins. The beads also reinforce the fin 1 and enlarge the surface area thereof.

Each bead 80 is located in a solid portion 60 of the fin situated between the first and third groups 20, 30 on the one hand, and the second and fourth groups 40, 50 on the other hand.

The bead projects above the plane of the fin 1 and has a V-shaped cross-section (see FIG. 5).

In the heat exchanger described above, each louver group has a remote edge e facing away from a respective lower group and facing an edge of another louver group and extending parallel with respect to a direction s of the air flow. The air current flowing over those edges e is not well mixed, resulting in the creation of a wider dead air region behind each tube 2, as well as an increase in the pressure drop, thereby reducing the heat transfer efficiency of the heat exchanger.

Furthermore, since the beads are formed only in vertical alignment with the tubes 2, the strength of portions of the fin 1 disposed in front of and behind the tubes 2 is not improved, which greatly lowers the overall strength of the fin 1. In addition, there are insufficient beads to satisfactorily drain all of the dew formed on the surface of the fin 1.

Summary of the Invention

Therefore, it is an object of the present invention to provide a heat exchanger fin which provides an improved heat transfer performance due to the turbulence and mixture of the air currents that flow through spaces formed between a plurality of flat fins, and also effectively reduces an air dead region found behind each tube 2 in a direction of the air flow and thus improves the heat transfer performance.

Another object of the present invention is to provide an improved draining of the concentrated water generated from the heat exchanging tubes, as well as an enlargement of the surface area of the flat fins, and an improved strength of the flat fins.

The present invention relates to a heat exchanger adapted for use with an air conditioner. The heat exchanger comprises a plurality of parallel vertical flat fins spaced apart to conduct air flows therebetween, and horizontal pipes extending perpendicularly through the fins and adapted to conduct a refrigerant. Each fin comprises a body having an array of louver groups formed therein. The louver groups include first, second, third, and fourth louver groups. The first and second louver groups are disposed over a respective pipe. The second louver group is disposed behind the first louver group with reference to a direction of air flow. The third and fourth louver groups are disposed beneath a respective pipe. The fourth louver group is disposed behind the third louver group. Each louver group includes a plurality of louvers forming slits through the body. The slits extend transversely relative to the air flow direction and generally radially with respect to the respective pipe. Each louver group includes a proximate edge facing a respective pipe, and a remote edge facing away from a respective pipe. The remote edge is spaced from the respective pipe by a substantially constant separation distance.

Each fin preferably includes a plurality of vertical ridges projecting beyond a plane of the fin. Some of the ridges are disposed in vertical alignment with respective pipes. Some of the ridges are disposed in front of respective pipes. Some of the ridges are disposed behind respective pipes.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT OF THE INVENTION

Figure 1:
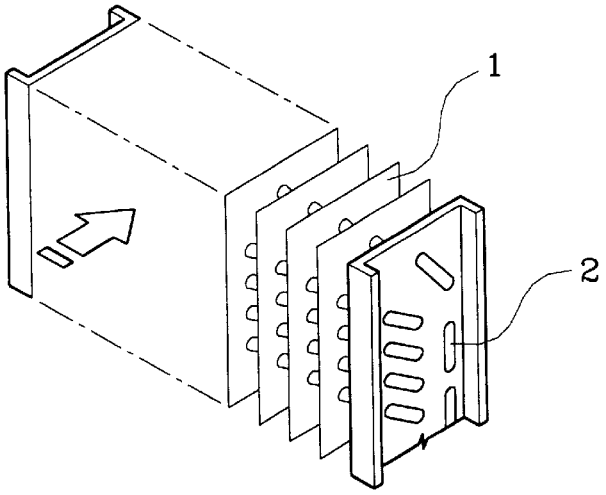
FIG. 1 (PRIOR ART)
FIG. 1 is a perspective view illustrating a conventional heat exchanger.
Figure 2:
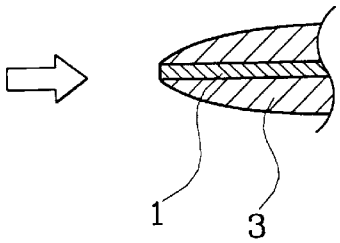
FIG. 2 (PRIOR ART)
FIG. 2 is an enlarged sectional view of a flat fin of the heat exchanger of FIG. 1, showing the characteristics of the thermal fluid flowing about a conventional fin.
Figure 3:
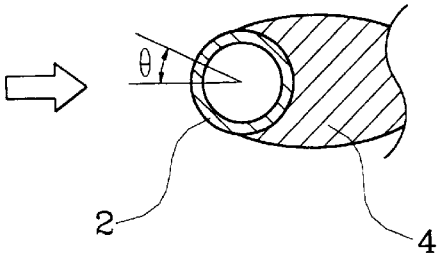
FIG. 3 (PRIOR ART)
FIG. 3 is an enlarged sectional view of a the heat exchanging tube of the heat exchanger of FIG. 1, showing the characteristics of the thermal fluid flowing about the heat exchanging tube.

The preferred embodiment according to the present invention will now be described in detail in accordance with the accompanying drawings. The same or corresponding elements or parts as in FIGS. 1–5 are designated with like references throughout FIGS. 6–10.

In the drawing, reference numeral 100, and box B (FIG. 7) denotes an array of louver groups formed in a flat fin 1 so as to be radially located around a respective tube 2. The tube 2 extends perpendicularly through the fin to conduct refrigerant. The slit-forming louvers of those louver groups cause air currents to become turbulent and mixed, thereby effectively reducing a dead air region behind the tube with reference to the direction of air flow, and thereby improving the heat transfer performance.

Figure 6:
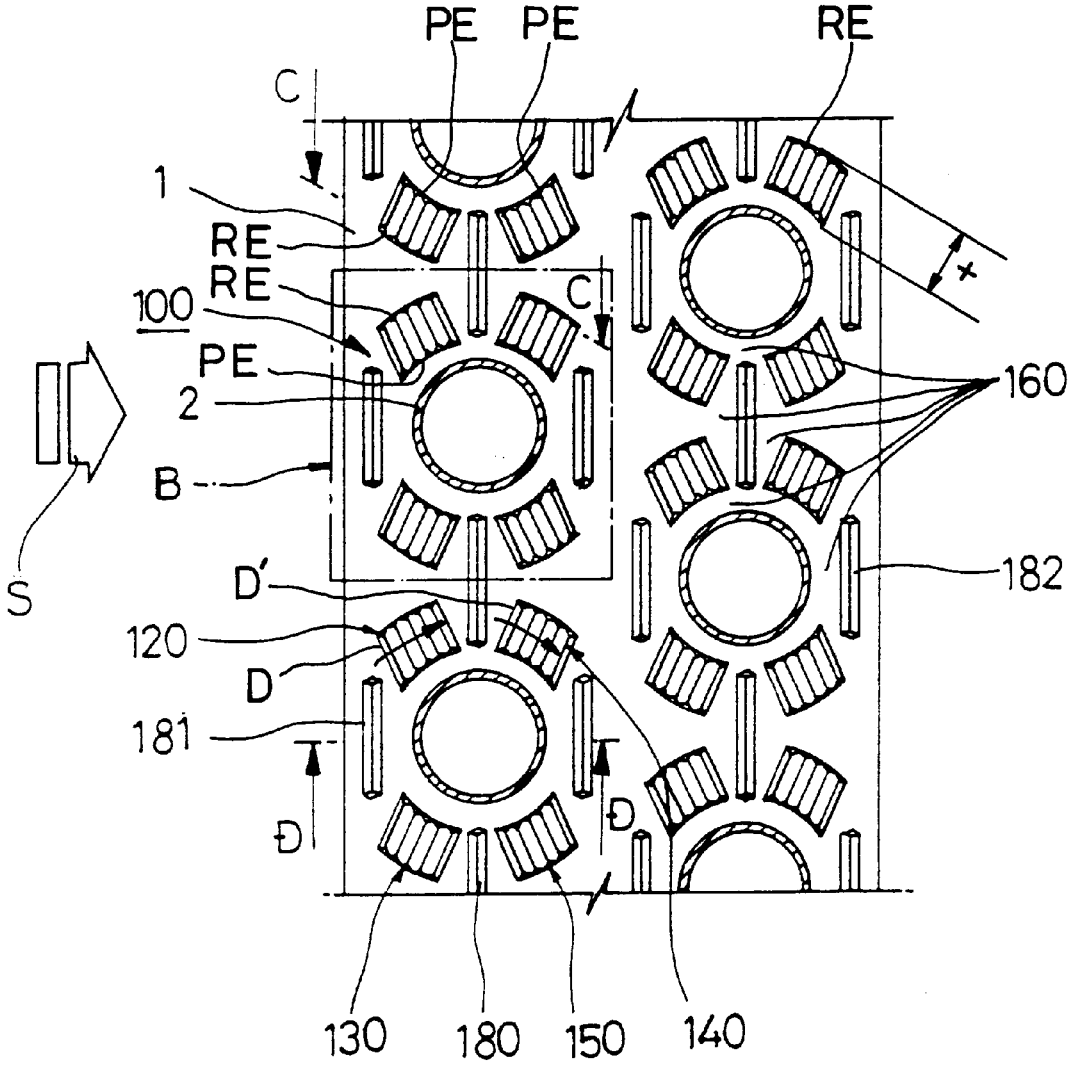
FIG. 6 is a front view of a flat fin in accordance with a heat exchanger of the present invention.
Figure 7:
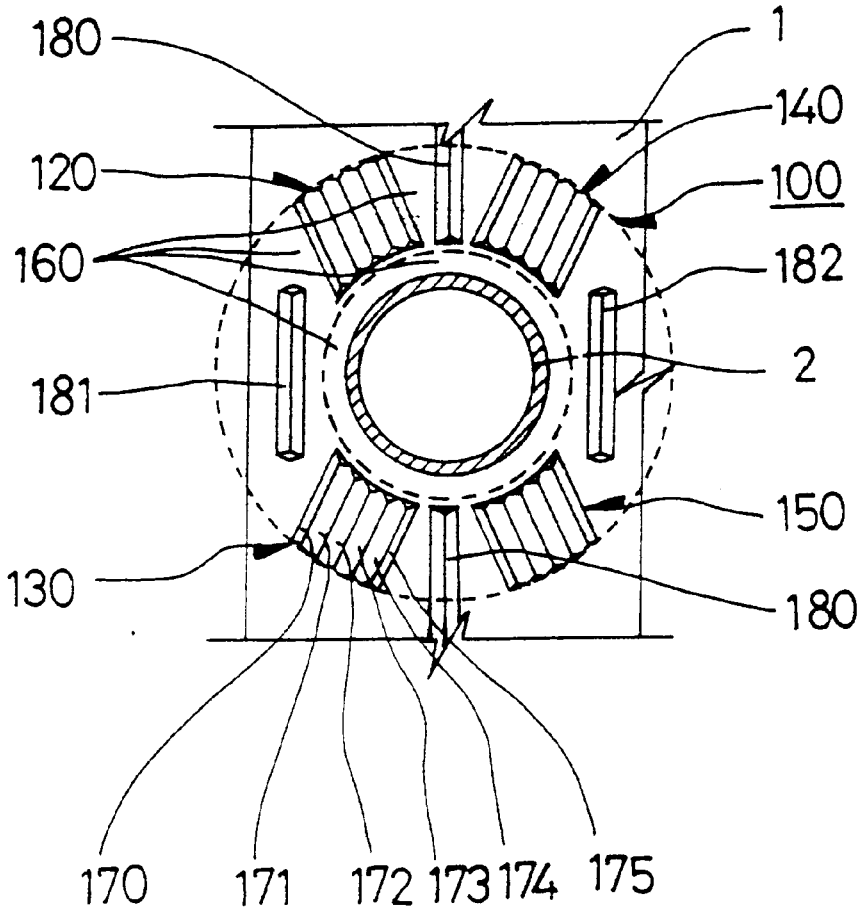
FIG. 7 is an enlarged view of the portion B in FIG. 6.
Figure 8:
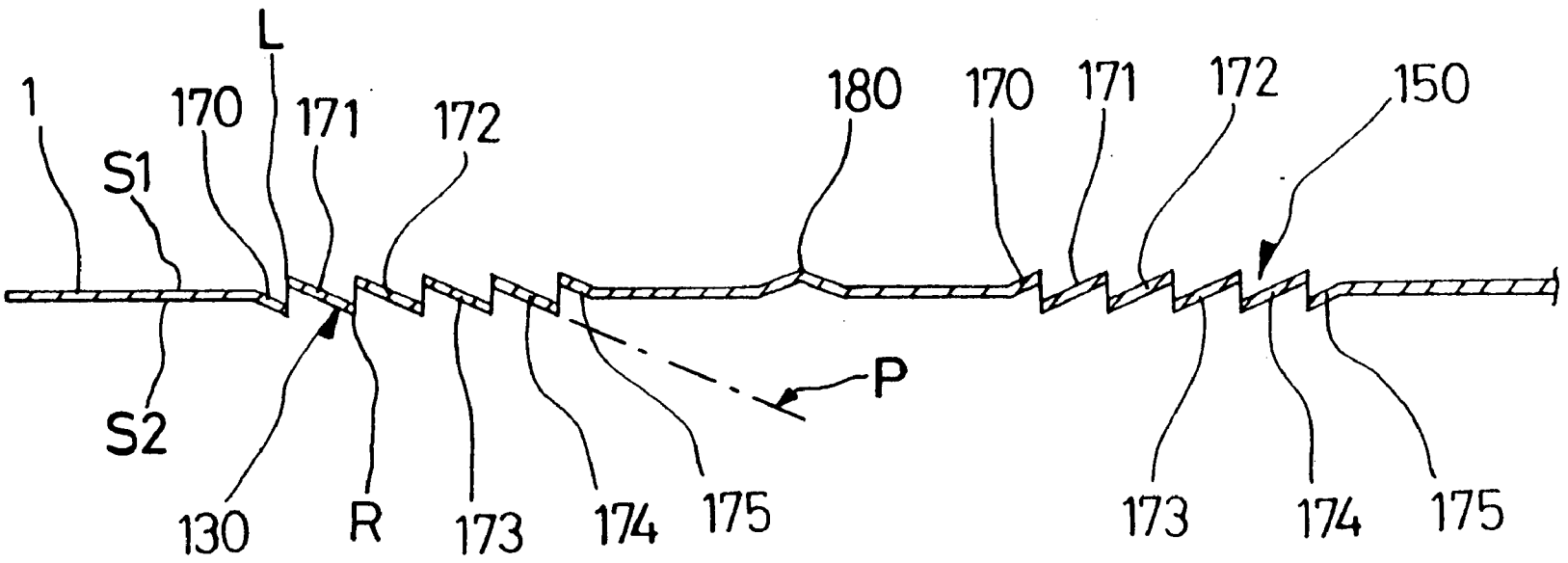
FIG. 8 is a sectional view of the flat fin taken along the section line C—C in FIG. 6.

Each array 100, as shown in FIGS. 6–8, comprises an upper louver pattern, and a lower louver pattern. The upper louver pattern includes a first louver group 120 configured to guide an air current flow in a first direction D, and a second louver group 140 which is inclined relative to the first louver group 120 such that the air current is guided in a second direction D' which is angled with respect to the first direction (see FIG. 6). The lower louver pattern disposed below the tube, comprises a third louver group 130 and a fourth louver group 150 also inclined relative to one another. The louver groups 120, 140, 130, and 150 of each array are radially positioned around a respective tube 2.

Also, the first and third louver groups 120 and 130 are arranged in mirror image relationship to each other such that the air currents flowing over both surfaces S1 and S2 of the fin 1 along the areas between vertically adjacent tubes 2, become turbulent and mixed. Further, the second and fourth louver groups 140 and 150 are similarly arranged in mirror image relationship to each other such that the respective air currents after having passed the groups 120 and 130 continue to traverse the remaining area between the tubes while becoming turbulent and mixed, thereby reducing the size of a dead air region located behind the tubes.

Each of the louver groups comprises louvers 170–175 lying in planes P inclined obliquely relative to the plane of the fin, as can be seen in FIG. 8. That is, each of the louvers 171–174 has a left end L projecting past the first fin surface S1, and a right end R extending past the second surface S2 of the fin. Each louver forms a slit extending transversely to the air flow traversing that particular louver (see FIG. 6). The louvers are formed by way of a cutting and twisting process, whereby they are integrally formed with the fin.

A solid portion 160 of the fin defines a circular area defined between lower or proximate edges RE of the first and second louver groups 120, 140 and an upper outer circumference of the tube 2. The proximate edges RE face the respective pipe. The first and second louver groups 120, 140 are thus radially spaced from the tube 2. Similarly, remote edges RE of the third and fourth louver groups 130, 150 are radially spaced from a lower outer circumference of the tube 2, with a generally round base portion 160 interposed therebetween.

The first and second louver groups 120, 140 are symmetrically arranged relative to one another and are separated by a flat portion 160 of the fin. The same is true of the third and fourth louver groups 130, 150.

The louvers 170–175 of each of the louver groups are sequentially arranged without any portion of the fin being disposed therebetween, as can be seen in FIG. 8.

Each lower group includes a remote edge RE disposed remotely from the respective tube 2. The remote edge RE faces away from the respective pipe and faces a corresponding remote edge RE of another louver group. Those remote edges RE are generally curved and oriented generally concentrically with respect to the center of the respective tubes. Thus, the remote edge RE is spaced from the outer surface of the respective tube 2 by a substantially constant separation distance X (FIG. 6). In practice, if the outer diameter d of the tube is 9.52 mm, then the separation distance X should be from 13.9 to 23.9 mm. If the outer diameter of the tube is 7 mm, then the separation distance X should be from 14 to 20.02 mm.

In the drawing, reference numerals 180 denote beads which are positioned in vertical alignment with respective tubes 2. Reference numerals 181 and 182 denote beads located respectively in front of and behind the tubes 2. The beads 180–182, which extend vertically, serve as water guides for draining (by gravity) water or dew that may have condensed on the heat exchanging fins or tubes 2. Also, the beads serve to reinforce the fin 1 and enlarge the effective heat exchanging surface area thereof.

Figure 9:
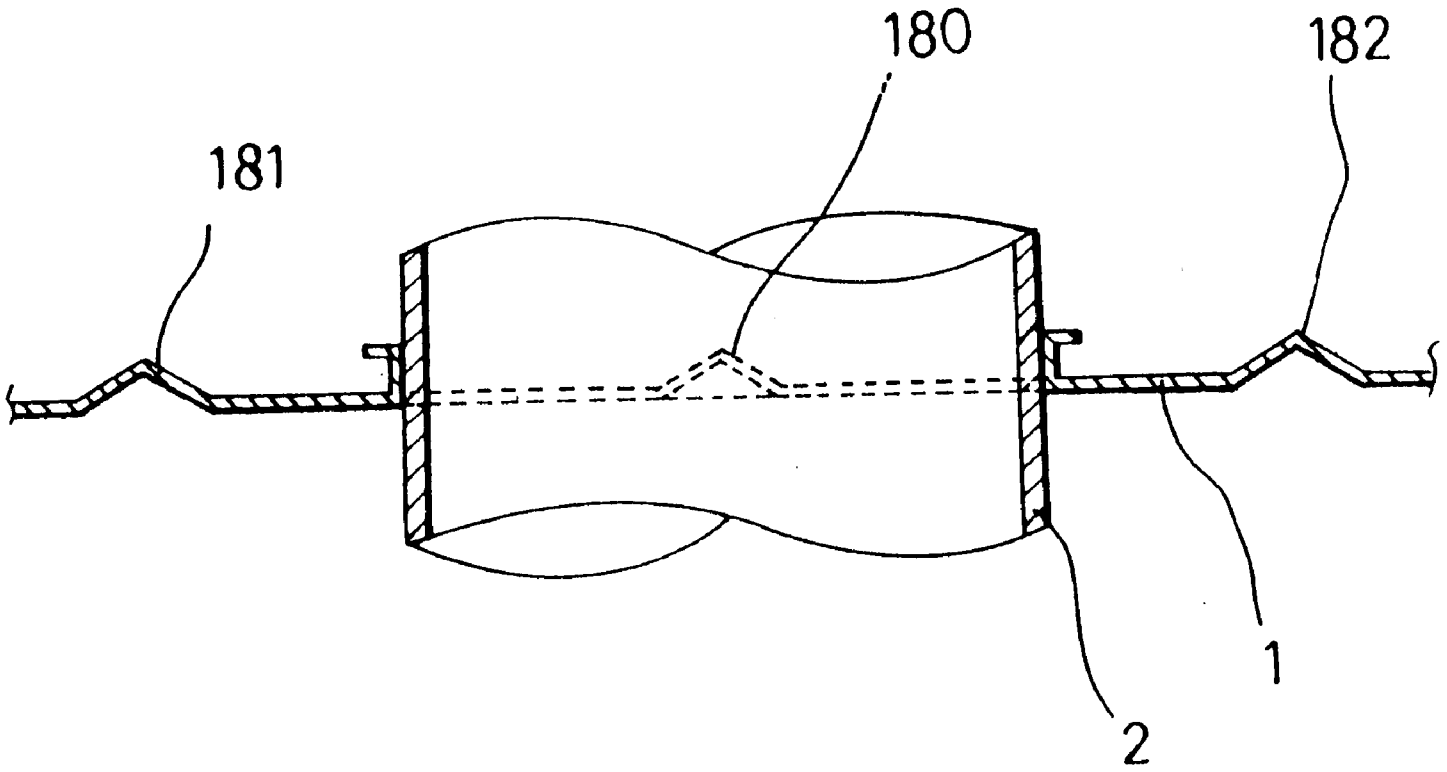
FIG. 9 is a sectional view of the flat fin taken along the section line D—D in FIG. 6.
Figure 10:
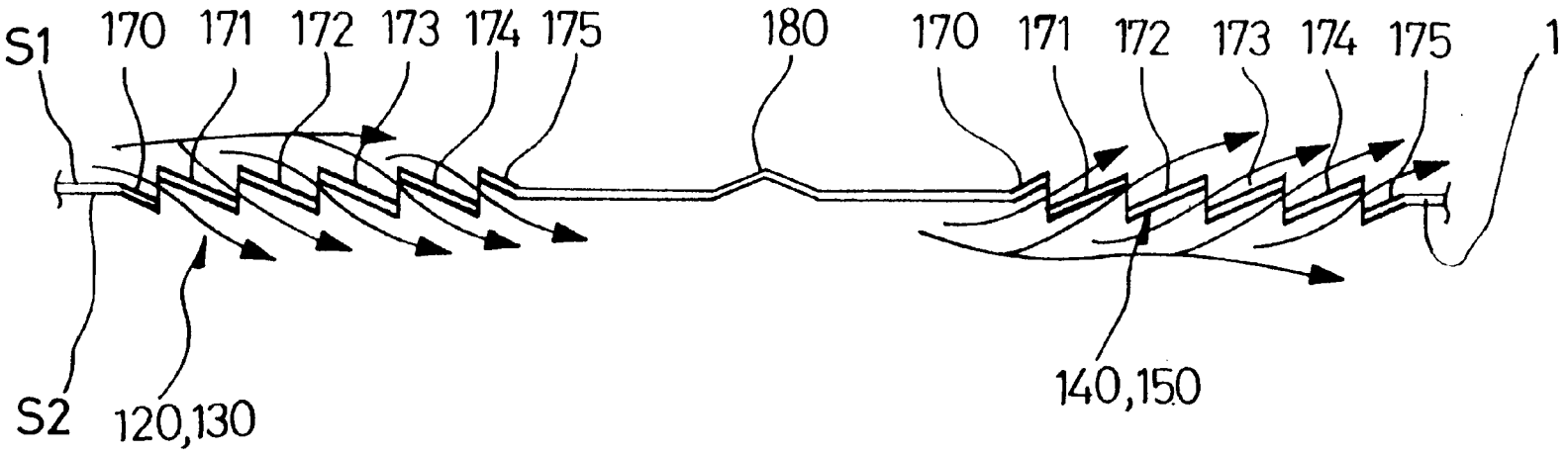
FIG. 10 is a schematic diagram explaining the air currents flow in the flat fin in accordance with the present invention.

Each bead 180, as shown in FIG. 7, has a lower portion equidistantly spaced from the first and second louver groups 120, 140, and an upper portion equidistantly spaced from the third and fourth louver groups 130, 150. Each bead is V-shaped in cross-section so as to project beyond the plane of the fin, as can be seen in FIG. 9.

The beads 181, 182 are positioned respectively in front of, and behind, a respective tube 2, and are spaced from the tube by equal distances. All of the beads are of V-shaped cross-section and project from the same surface (i.e., the first surface S1) of the fin. A length of each of the beads 180–182 is substantially equal to the outer diameter d of the tube 2.

The operation of the heat exchanger will now be described. When the air currents flow in the spaces defined between adjacent fins 1 in the direction of the arrow S in FIG. 6, the air currents sequentially pass through the first and second louver groups 120 and 140, or the third and fourth louver groups 130, 150 while passing around the respective tube 2. As the air current flowing along the first surface S1 encounters the first louver group 120, some of the air is caused to flow through the fin via the slits defined by the louvers 170–175, whereby the air becomes transferred to the second surface S2 of the fin. Simultaneously, that air becomes mixed with air that is already flowing along the second surface S2 so as to become turbulent and mixed therewith. Thereafter, the air flowing along the second surface S2 encounters the second louver group 140, and some of that air is caused to flow back through the fin via the slits formed by the louvers of the second louver group, and is thus transferred to the first surface S1 where it becomes turbulent and mixed with air already flowing along the first surface S1.

It will be appreciated that the air flowing in front of and behind the tubes 2 becomes turbulent and mixed, thereby reducing dead air regions.

The base portions 160 disposed between the tube and the louver groups enable the turbulent air currents passing through the louver groups to be capable of further flowing into the dead air region. Thus, the dead air region becomes further reduced and the heat transfer effect is improved.

Figure 4:
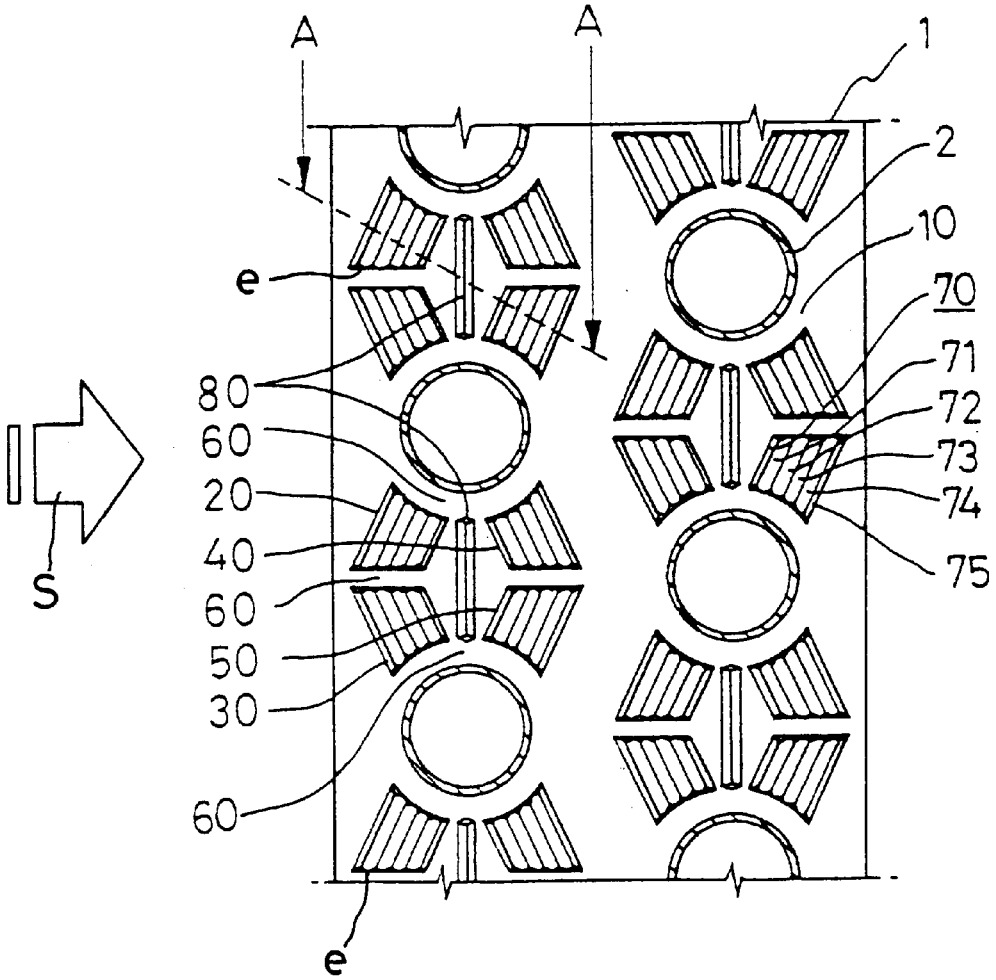
FIG. 4 (PRIOR ART)
FIG. 4 is a front view of a flat fin of a heat exchanger disclosed in a copending application.
Figure 5:
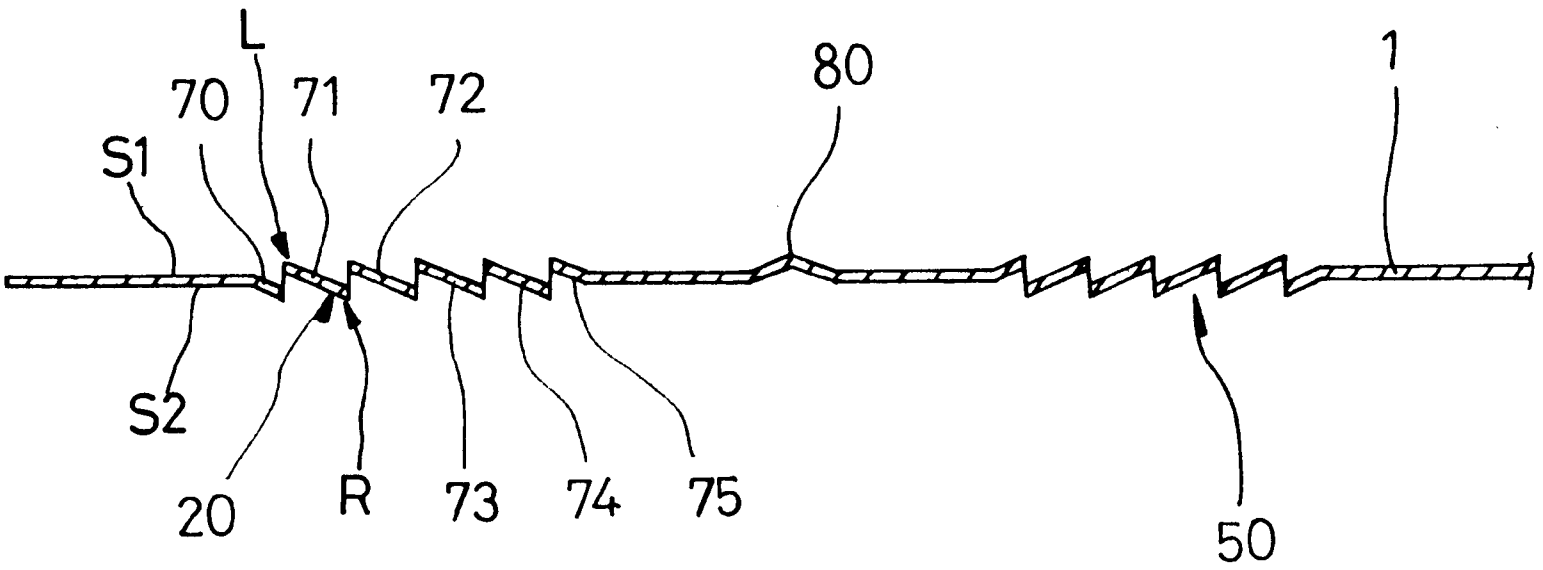
FIG. 5 (PRIOR ART)
FIG. 5 is a sectional view of the flat fin taken along the section line A—A in FIG. 4.

Since the remote edges RE of the louver groups are curved generally concentrically about the respective tubes 2 to define generally constant separation distances X, the air flowing across those edges RE is better mixed than in the case of edges that extend parallel to the direction of air flow (see edges e of FIG. 4).

Water which condenses on the fin and pipes, due to temperature differences between the fin and the air current is drained away by the beads 180–182. Since beads are provided in front of, behind, above, and below the tubes 2, there is a greater number of such beads available for draining the condensed water. Also, a greater reinforcement of the fin is provided. It will be appreciated that the present invention reduces a pressure drop of the flowing air current and promotes the turbulence and mixing of the air currents. Further, the invention improves the heat transfer effect and reduces the dead air around the heat exchanging tubes. Moreover, the beads provide a greater reinforcement of the fins and a greater enlargement of the surface area thereof. Furthermore, there are a greater number of beads for draining away condensed water.

Although the present invention has been described in connection with a preferred embodiment thereof, it will be appreciated by those skilled in the art that modifications, substitutions and deletions not specifically described may be made without departing from the spirit and scope of the invention as defined in the appended claims.

We claim:

1. A heat exchanger comprising a plurality of parallel vertical flat fins spaced apart to conduct air flows therebetween, and horizontal pipes extending perpendicularly through the fins and adapted to conduct a refrigerant, each fin comprising a body having arrays of louver groups formed therein; each array disposed around a respective one of the pipes, each array consisting of first, second, third and fourth louver groups, whereby there are no more than four louver groups disposed around each of the pipes; the first and second louver groups being disposed above a respective pipe, the second louver group disposed behind the first louver group with reference to a direction of air flow; the third and fourth louver groups disposed beneath the respective pipe, the fourth louver group disposed behind the third louver group; each louver group including a plurality of louvers forming slits through the body, adjacent ones of the louvers of each louver group being spaced apart solely by one of the slits, the slits extending transversely relative to the air flow direction and generally radially with respect to the respective pipe; each louver group including a proximate edge facing a respective pipe, and a remote edge facing away from the respective pipe and spaced from the respective pipe by a substantially constant separation distance the first and third louver groups disposed in front of their respective pipes, and the second and fourth louver groups disposed behind the respective pipe, each louver lying in a plane oriented at an oblique angle with respect to a plane of the fin, the louvers of the first and third groups being inclined oppositely with respect to the louvers of the second and fourth groups.

2. The heat exchanger according to claim 1, wherein each fin further includes a plurality of vertical ridges projecting beyond a plane of the fin, each projection forming a non-slitted continuation of the fin for preventing a transfer of air from one side of the fin to the opposite side thereof, some of the ridges disposed in vertical alignment with respective pipes, some of the ridges disposed in front of respective pipes, and some of the ridges disposed behind respective pipes.

3. The heat exchanger according to claim 1 wherein the pipe has an outer diameter of 9.52 mm, and the separation distance is from 13.9 to 23.9 mm.

4. The heat exchanger according to claim 1 wherein the pipe has an outer diameter of 7 mm, and the separation distance is from 14 to 20.02 mm.

* * * * *